US005706832A

United States Patent [19]

Gold

[11] Patent Number: 5,706,832

[45] Date of Patent: Jan. 13, 1998

[54] CIGAR HOLDER

[75] Inventor: William Stuart Gold, Oak Park, Ill.

[73] Assignee: Jupiter Products Co., Inc., Oak Part, Ill.

[21] Appl. No.: 747,624

[22] Filed: Nov. 13, 1996

[51] Int. Cl.[6] ..... A24F 13/22

[52] U.S. Cl. ..... 131/240.1; 131/250

[58] Field of Search ..... 131/231, 235.1, 131/238, 240.1, 241, 250, 256, 257, 329; D19/75, 77, 81, 83, 84; D27/102, 104, 138

[56] References Cited

U.S. PATENT DOCUMENTS

| | | | |
|---|---|---|---|
| 177,456 | 5/1876 | Blackford | 131/240.1 |
| 743,253 | 11/1903 | Crapp . | |
| 1,688,148 | 10/1928 | Martin . | |
| 2,448,105 | 8/1948 | Lynch | 131/240.1 X |
| 2,580,985 | 1/1952 | Wooden . | |
| 2,826,206 | 3/1958 | Slater . | |
| 2,931,365 | 4/1960 | McKenzie . | |
| 2,950,836 | 8/1960 | Murdock . | |
| 3,387,614 | 6/1968 | Beuscher | 131/240.1 X |
| 4,895,329 | 1/1990 | Sloan . | |
| 5,320,444 | 6/1994 | Bookwalter et al. . | |
| 5,524,646 | 6/1996 | Reich . | |

FOREIGN PATENT DOCUMENTS

| | | | |
|---|---|---|---|
| 599337 | 6/1934 | Germany | 131/240.1 |
| 679629 | 8/1939 | Germany | 131/240.1 |
| 0460943 | 2/1937 | United Kingdom | 131/240.1 |

*Primary Examiner*—Jennifer Bahr

*Attorney, Agent, or Firm*—Trexler, Bushnell, Giangiorgi & Blackstone, Ltd.

[57] ABSTRACT

A smoking article holding device has an article holder, a pivot assembly, and a clamping assembly. The article holder includes two spaced-apart arms having a plurality of paired, opposed, concave arcuate recesses which facilitate holding a corresponding plurality of smoking article sizes. The article holder is attached to a linkage of a pivot assembly. The linkage is attached to a pivot base to facilitate pivoting orientation of the attached holder in a desired position. The pivot base of the pivot assembly is attached to the clamping assembly. A pair of spaced-apart clamping arms are included in the clamping assembly and retained by an adjustable retainer. The adjustable retainer includes a threaded adjustment stud and an adjustment knob which facilitate tightening and loosening for attaching and removing the clamping assembly from a selected surface.

19 Claims, 1 Drawing Sheet

CIGAR HOLDER

BACKGROUND

The present invention relates to a holding device for holding smoking articles such as cigars, cigarettes, and pipes.

Individuals who use any one of a variety of smoking articles find that they must always hold the article in one hand and, hence, only have one hand free for their activities. If two hands are required for an activity, they must place the smoking article in an ashtray or in an inconvenient location. Probably the only remaining option is to ask someone else to hold the article, for instance a cigar.

One of the problems smokers encounter is that they often need to place an article only temporarily. Such situations arise, for example, when golfing. A golfer may enjoy a cigar while playing golf but may also need to temporarily place the cigar while teeing off, driving or putting. Use of an ashtray is not convenient on a golf course. Ashtrays are cumbersome and tend to be unstable devices. For example, it is difficult to attach an ashtray to a golf cart or to a golf bag in any usable manner. As such, it would be preferable to provide some form of cigar holder which could be attached to a golf cart or a golf bag for convenient use by a golfer.

There is no known device which can be attached to a golf cart or a golf bag to facilitate temporary holding of a cigar or other smoking article. Further, there is no known device for attachment to a variety of surfaces to temporarily hold a cigar or other smoking article.

Other examples can be readily found in which a smoking article holding device would be beneficial. For example, it might be beneficial to provide such a holding device in a vehicle or in a home to temporarily hold a cigar in a desired orientation. Additionally, would be beneficial to provide a device which can be oriented in a variety of positions to facilitate a selected orientation by the smoker. For example, in using such a device with a golf cart, it would be desirable to maintain a selected orientation of the cigar either to maintain the combustion of the cigar material or to minimize the combustion of the cigar material. Similarly, the same examples might apply with regard to pipes or cigarettes.

As such, it would be desirable to provide a smoking article holding device which can be attached to a variety of surfaces and which can be adjusted to a selected orientation.

OBJECTS AND SUMMARY

An object of the present invention is to provide a smoking article holding device which can be attached to a variety of surfaces and which can be adjusted to provide a selected orientation for holding a smoking article.

Another object of the present invention is to provide a smoking article holding device which can accommodate a variety of smoking article sizes, such as cigars.

Briefly, and in accordance with the foregoing, the present invention envisions a smoking article holding device which has an article holder, a pivot assembly, and a clamping assembly. The article holder includes two spaced-apart arms having a plurality of paired, opposed, concave arcuate recesses which facilitate holding a corresponding plurality of smoking article sizes. The article holder is attached to a linkage of a pivot assembly. The linkage is attached to a pivot base to facilitate pivoting orientation of the attached holder in a desired position. The pivot base of the pivot assembly is attached to the clamping assembly. A pair of spaced-apart clamping arms are included in the clamping assembly and retained by an adjustable retainer. The adjustable retainer includes a threaded adjustment stud and an adjustment knob which facilitate tightening and loosening for attaching and removing the clamping assembly from a selected surface.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DESCRIPTION

Figure 2:
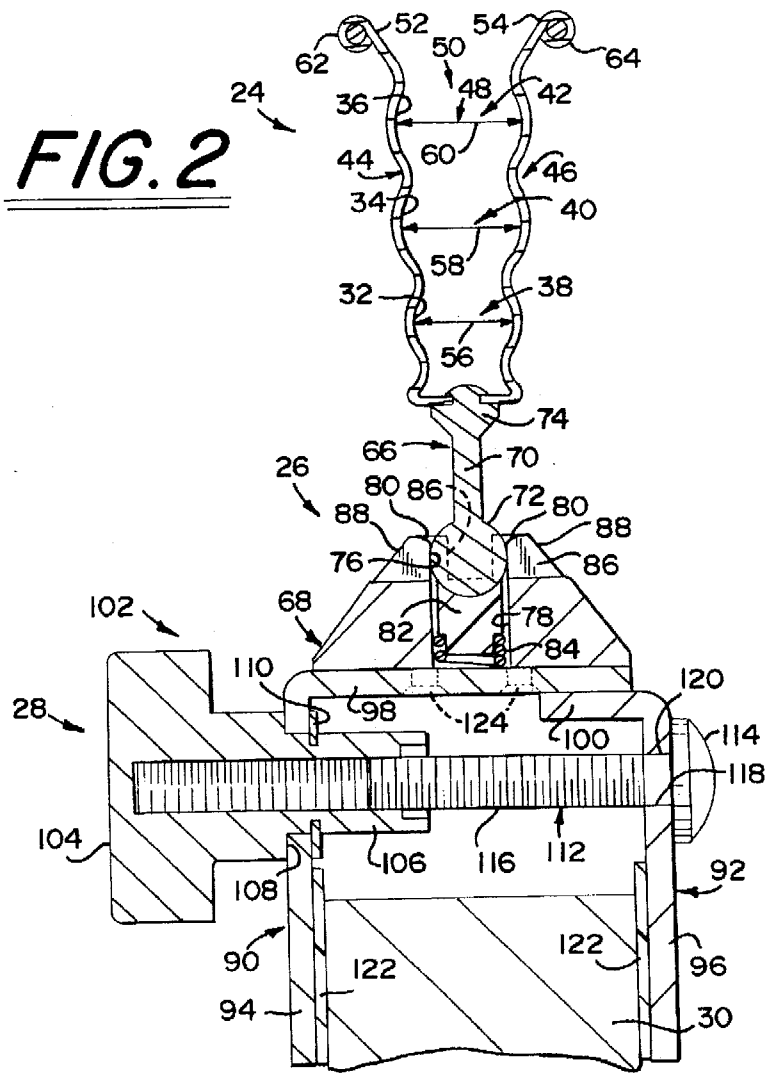
FIG. 2 is a partial fragmentary, cross-sectional, side elevational view of the smoking article holding device as shown in FIG. 1 showing the relative position and relationship between the various components thereof.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

Figure 1:
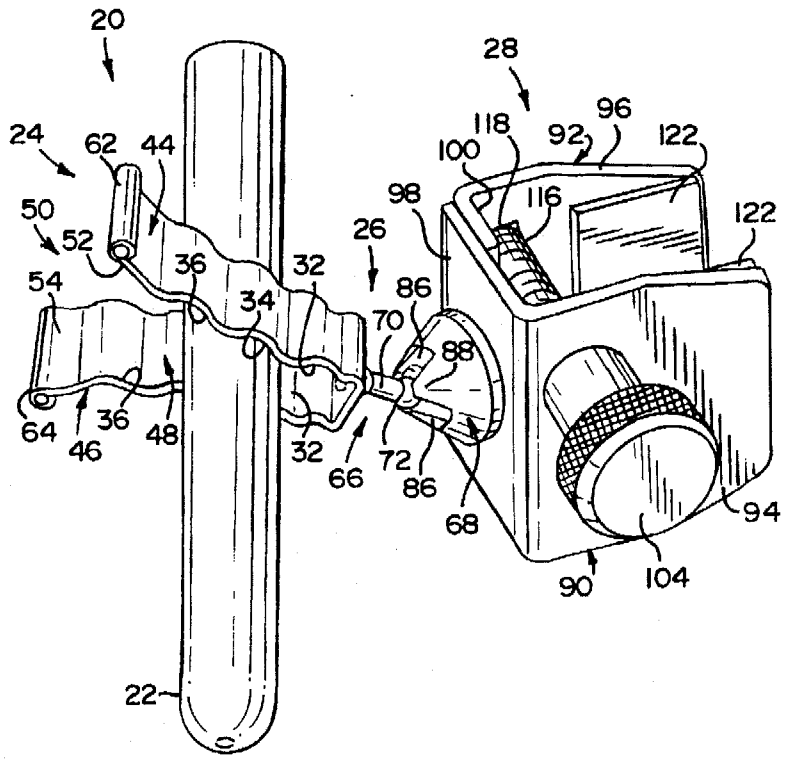
FIG. 1 is a perspective view of a novel smoking article holding device of the present invention showing an article holder positioned by pivoting the linkage relative to the pivot base to position a cigar retained therein in a selected orientation.

As shown in FIG. 1, a smoking article holding device 20 is shown holding a cigar 22. The smoking article holding device includes a holder 24, a pivot assembly 26 and a clamping assembly 28. The holder 24 is spring biased to retain a cigar 22 positioned therein without the addition of clamps or other additional components to secure the cigar 22 in the holder 24. The holder 24 is attached to the pivot assembly 26, as will be described in greater detail hereinbelow, which allows the holder 24 to be oriented in a desired position. The clamping assembly 28 can be clamped to a support surface 30 (as shown in FIG. 2) to secure the holding device 20 on a desired structure such as a golf cart, car, boat, table, chair or any other support surface to which it can be clamped.

As mentioned above, the holder 24 is spring biased to retain a cigar without the addition of any other components such as clamps, catches, etc. The holder 24 includes a first, second, and third pair, 32, 34, 36 of concave recesses. Each pair of concave recesses 32, 34, 36, is positioned with an open end of each recess in opposition to a corresponding recess. The orientation of the pairs of concave recesses 32, 34, 36 is clearly shown in FIG. 2. The pairs of recesses 32, 34, 36 are generally arcuate to accommodate the generally arcuate convex surface of a cigar 22. It is expected that other concave recess shapes may be used to achieve desired results within the scope of the present invention. However, for the present discussion of the preferred embodiment, the concave recesses will be referred to as being arcuate consistent with the generally arcuate exterior surface of cigars as also generally referred to herein. Each of the pairs of concave arcuate recesses 32, 34, 36 define a corresponding first, second and third gripping area 38, 40, 42, respectively. Each gripping area 38, 40, 42 generally corresponds to the size of a standardized caliber of cigar.

The holder includes a pair of arms 44, 46 in which the pair of concave arcuate recesses 32, 34, 36 are formed. The spaced-apart arms 44, 46 define a mouth 48 therebetween. As shown in the present embodiment, a single strip of material is used to form the two arms 44, 46 and the corresponding pairs of recesses 32, 34, 36. Additionally, an entry end 50 of the mouth 48 is defined between two outwardly sloped leading ends 52, 54 of the corresponding first and second arms 44, 46, respectively. Preferably the holder 24 is formed of a material which will provide a spring biasing effect when the arms 44, 46 are flexed slightly outwardly.

A diametral dimension 56, 58, 60 of the first, second and third gripping areas 32, 34, 36, respectively, are sized to be slightly smaller than the standard exterior dimension of a standard caliber of cigar. In this manner, the arms 44, 46 are slightly outwardly displaced when a cigar is placed through the entry end 50 of the mouth. The cigar can quickly, easily and naturally positioned in the appropriate gripping area 38, 40, 42. Terminal ends 62, 64 of the sloped leading ends 52, 54 are rounded so as to prevent damaging the exterior surface of a cigar 22 positioned in the entry end 50 of the mouth 48. As it is undesirable to puncture the exterior surfaces of a cigar or otherwise damage it, the sloped leading ends 52, 54 and the rounded terminal ends 62, 64 help assure that the holding device 20 does not damage the cigar 22.

Controlled and retainable positioning of the holder 24 is achieved by the pivot assembly 26 to which the holder 24 is attached. The pivot assembly 26 includes a movable linkage 66 which is retained in a pivot base 68. The linkage 66 includes a shaft 70 having an arcuate head 72 on one end thereof and a tip portion 74 attached to the holder 24 on the opposite end thereof. The pivot base 26 includes an arcuate socket 76 in which the arcuate head 72 is retained. A primary bore 78 extends through the pivot base 68 and communicates with the arcuate socket 76. It can be seen that the arcuate socket 76 includes extending portions 80 which extend inwardly relatively to the primary bore 78 to retain the arcuate head 72 within the arcuate socket 76. A seating member 82 is positioned in the primary bore 78. A spring 84 is positioned between the seating member 82 and an abutting surface of the clamping assembly 28 to create a spring force against the seating member 82 to provide additional frictional forces between the arcuate socket 76, arcuate head 72 and the seating member 82.

As further shown in FIGS. 1 and 2, the pivot base 68 includes a plurality of positioning slots 86. The positioning slots 86 are defined between neighboring fingers 88 of the pivot base 26. Generally, there needs to be a sufficient number of fingers 88 to retain the arcuate head 72 in the pivot base 68. The width dimension of the positioning slots 86 is sized to receive the shaft portion 70 of the linkage 66 therein. The positioning slots 86 facilitate increased rotation of the holder 24 relative to the clamping assembly 28 and provide additional resistance to movement because the shaft 70 is positioned between neighboring fingers 88 of the pivot base 68.

The clamping assembly 28 include a pair of clamp arms 90, 92 which are generally L-shaped members. The clamp arms 90, 92 include a gripping wall 94, 96, respectively. Each of the clamp members 90, 92 also have inwardly extending flanges 98, 100, respectively. The flange 98 of the first clamping member 90 extends over the flange 100 of the second clamping member 92. The first flange 98 is larger than the second flange 100 and provide an attachment structure for the pivot base 68.

An adjustable retainer 102 holds the clamp members 90, 92 together and adjustably urges the members 90, 92 inwardly and outwardly to secure the clamping assembly 28 to a support surface 30. The adjustable retainer 102 includes an adjustment knob 104 having an elongated portion 106 which extends through a hole 108 in the first arm 94 and is retained in position by retaining ring 110. The adjustable retainer 102 also includes an adjustable stud 112. The stud 112 includes a head 114 and a threaded shank 116. The threaded shank 116 extends through a receiving aperture 118 formed in the second arm gripping wall 96. A squared shoulder 120 is positioned between the shank 116 and the head 114 and the aperture 118 is similarly sized and dimensioned. The squared shoulder 120 and squared aperture 118 prevents rotation of the stud 112 relative to the second clamp member 92.

The adjustable stud 112 is engaged with the elongated portion 106 of the adjustment knob 104. Rotation of the adjustment knob 104 threadedly advances or extends the second clamp member 92 relative to the first clamp member 90.

Additionally, friction surfaces 122 are attached to the inside surfaces of the first and second arm gripping walls 94, 96. The surfaces or pads 122 may also provide a protective function by being formed of a compressible material. As such, the pads 122 may protect the surface of the support surface 30.

In use, the smoking article holding device 20 of the present invention can be clamped to a support surface 30 upon adjusting the first and second members 90, 92 by operation of the adjustable retainer 102 to appropriately fit a selected support surface 30. The adjustable retainer 102 is tightened by rotating the adjustment knob 104 relative to the stud 112 to draw the second member 92 towards the first member 90. Once sufficiently clamped, the holder 24 can be adjusted to a desired position by moving the holder 24. The holder 24 has a considerable range of motion as a result of the pivot assembly 26. The linkage 66 is moved relative to the pivot base 68 because the tip portion 74 is attached to the holder 24. Pivoting and rotation of the arcuate heads 72 in the arcuate socket 76 facilitates placement of the holder 24 in a desired position. The shaft 70 may be positioned in a corresponding positioning slot 86 to maintain or achieve a desired position of the holder 24. Additionally, the seating member 82 creates an upward force against the arcuate head 72 and on the arcuate slot 76 by means of the spring 84. The pivot base 68 is attached to the first flange 98 by means of retaining screws 124.

The gripping areas 38, 40, 42 of the holder 24 are arranged with the smallest gripping area 38 positioned downwardly along the arms 44, 46 and the largest gripping area 42 positioned upwardly along the arms 44, 46 toward the entry 50 of the mouth 48. In this manner, the largest cigars will be captured in the third gripping area 42, with medium and smaller cigars being passed beyond the largest or third gripping area 42. Medium cigars will be captured in the second gripping area 42 because there are sufficiently large to pass through the third gripping area 42 without being biasedly retained therein. Further, the smallest cigars will pass through the second and third gripping areas 40, 42 and be retained in the smallest or first gripping area 38 in a similar manner. The gripping force of the arms 44, 46 on the cigar placed in the mouth 48 of the holder 24 is sufficiently small so that the cigar may easily be removed by gently pulling the cigar from the mouth 48. The biasing characteristics of the arms 44, 46 produce a spreading or outward deflection of the arms 44, 46 relative to one another thereby gently releasing the cigar.

While a preferred embodiment of the present invention is shown and described, it is envisioned that those skilled in the art may devise various modifications and equivalents without departing from the spirit and scope of the invention as defined by the appended claims. The invention is not intended to be limited by the foregoing disclosure.

The invention claimed is:

1. A smoking article holding device comprising:

an article holder having a pair of spaced-apart arms defining a mouth therebetween, said pair of spaced-apart arms having a plurality of complimentary, opposed concave recesses for receiving a variety of sizes of smoking articles therebetween, said arms being spaced apart to provide a spring biased compressive force to retain a smoking article between a selected pair of said opposed concave recesses;

a pivot assembly connected to said article holder, said pivot assembly facilitating movement of said article holder; and a clamping assembly connected to said pivot assembly said clamping assembly for selectively attaching said smoking article holding device to a support surface.

2. A smoking article holding device as recited in claim 1, wherein said plurality of complimentary concave recesses are generally arcuate.

3. A smoking article holding device as recited in claim 1, said pivot assembly further comprising:

a pivot base attached to said clamping assembly and a linkage component extending from said pivot base and connected to said article holder.

4. A smoking article holding device as recited in claim 3 wherein said pivot assembly further comprises:

an arcuate socket in said pivot base, said linkage having an arcuate head positioned in said arcuate socket, a shaft extending from said arcuate head with a tip portion connected to said holder, said arcuate head retained in said arcuate socket for facilitating selective positioning of said holder relative to said clamping assembly to locate a smoking article retained in said holder in a desired position.

5. A smoking article holding device as recited in claim 4, said pivot base further comprising:

at least one positioning slot in said pivot base communicating with said arcuate socket, said positioning slot being sized and dimensioned to receive said shaft of said linkage therein for increasing the range of movement of said holder relative to said clamping assembly.

6. A smoking article holding device as recited in claim 5, said pivot base of said pivot assembly further comprising:

a primary bore communicating with said arcuate socket, a seating member positioned in said primary bore for abutting said arcuate head of said linkage to increase frictional engagement of said arcuate head in said arcuate socket and against said seating member to provide a movable friction fit of said linkage in said pivot base.

7. A smoking article holding device as recited in claim 6, further comprising a biasing member retained in said primary bore providing a biasing force against said seating member.

8. A smoking article holding device as recited in claim 2, said article holder comprising:

a single strip of material generally continuously formed with said arcuate recesses positioned at spaced-apart opposed locations, said spaced-apart arms having outwardly sloped leading ends to facilitate ease of engagement of a smoking article with said mouth and a selected pair of concave recesses.

9. A smoking article holding device as recited in claim 1, said article holder having three pairs of concave recesses positioned on said pair of spaced-apart arms, each of said concave recesses being formed as an arcuate recess being recessed away from an opposing recess for defining a gripping area therebetween, each of said three pairs of concave arcuate recesses define gripping areas of different dimensions to accommodate at least three different diameters of smoking articles, independently, in said article holder.

10. A smoking article holding device as recited in claim 9, wherein each of said three pairs of opposed concave arcuate recesses having different dimensions are arranged with the largest of the three positioned closest to the entry of the mouth and the smallest of the three being positioned closest to said linkage.

11. A smoking article holding device as recited in claim 1, said clamping assembly further comprising:

at least two L-shaped members, a first L-shaped member and a second L-shaped member, said first and second L-shaped members being operatively connected by an adjustable retainer being independently coupled to each of said first and second L-shaped members.

12. A smoking article holding device as recited in claim 11, said adjustable retainer further comprising an adjustment knob and a threaded stud, said adjustment knob being carried on one of said first and second L-shaped members and said adjustable stud being retained against rotation on the other of said first and second L-shaped members, said adjustment stud being threadedly engaged with said adjustment knob for facilitating threaded movement of said first and second L-shaped members relative to one another for facilitating adjustment of said clamping assembly to attach said clamping assembly to a support surface.

13. A smoking article holding device comprising:

an article holder having a pair of spaced-apart arms defining a mouth therebetween, said pair of spaced-apart arms having a plurality of complimentary, opposed concave arcuate recesses for receiving a variety of smoking articles therebetween, said arms being spaced apart to provide a spring biased compressive force to retain a smoking article therebetween, said mouth having an entry with sloped leading edges to facilitate engagement of said smoking article within said holder;

a pivot assembly including a pivot base and a linkage with said linkage being attached to said holder, said pivot base including an arcuate socket for retaining an arcuate head of said linkage therein to facilitate selective positioning of said holder relative to said pivot base; and a clamping assembly connected to said pivot assembly, said clamping assembly including spaced-apart clamping members and an adjustable clamping retainer, said spaced-apart clamping members being selectively adjusted for engaging a support surface by said adjustable retainer.

14. A smoking article holding device as recited in claim 13, said pivot base further comprising:

at least one positioning slot in said pivot base communicating with said arcuate socket, said positioning slot being sized and dimensioned to receive said shaft of said linkage therein for facilitating increased degree of movement of said holder relative to said clamping assembly.

15. A smoking article holding device as recited in claim 13, said pivot base of said pivot assembly further comprising:

a primary bore communicating with said arcuate socket, a seating member positioned in said primary bore for abutting said arcuate head of said linkage and a biasing member retained in said primary bore providing a biasing force against said seating member for providing increased frictional engagement of said arcuate head in said arcuate socket and against said seating member for providing a movable friction fit of said linkage in said pivot base.

16. A smoking article holding device as recited in claim 13, said article holder having three pairs of concave generally arcuate recesses positioned on said pair of spaced-apart arms, each of said pair of concave generally arcuate recesses being formed as arcuate recesses being recessed away from one another for defining a gripping area therebetween, each of said three pairs of concave arcuate recesses define gripping areas of different dimensions to accommodate at least three different diameters of smoking articles, independently, in said article holder, and wherein each of said three pairs of opposed concave arcuate recesses are arranged with the largest of the three positioned closest to the entry of the mouth and the smallest of the three being positioned closest to said linkage.

17. A smoking article holding device as recited in claim 13, said clamping assembly further comprising:

at least two L-shaped members, a first L-shaped member and a second L-shaped member, said first and second L-shaped members being operatively connected by an adjustable retainer being independently coupled to each of said first and second L-shaped members, said adjustable retainer including an adjustment knob and a threaded stud, said adjustment knob being carried on one of said first and second L-shaped members and said adjustable stud being retained against rotation on the other of said first and second L-shaped members, said adjustment stud being threadedly engaged with said adjustment knob for facilitating threaded movement of said first and second L-shaped members relative to one another for facilitating adjustment of said clamping assembly to attach said clamping assembly to a support surface.

18. A smoking article holding device as recited in claim 13, further comprising:

a friction surface applied to said clamping members of said clamping assembly for abutting a selected surface, said friction surfaces increasing a friction force against a support surface to which said smoking article holding device is attached.

19. A cigar holding device comprising:

a semi U-shaped retaining member, said semi U-shaped retaining member formed from a single strip of resilient material having a pair of opposed ends, said pair of opposed ends having a plurality of complimentary arc shaped recesses exerting a compression force toward each other;

a pivotal ball portion, said pivotal ball portion having an extension member operatively connected to said semi U-shaped retaining member, said extension member distancing said semi U-shaped retaining member from said pivotal ball portion;

a base member, said base member having a centered internal aperture retaining said pivotal ball portion, said base member allowing said pivotal ball portion to pivot about said base member in multiple circular orbits;

a biasing member, said biasing member located within said centered internal aperture of said base member, said biasing member exerting a biasing force against a surface of said pivotal ball portion, said biasing member retaining said pivotal ball portion in a friction fit against said base member; and a clamping member, said clamping member operatively connected to said base member, said clamping member allowing said tobacco retaining device to be detachably clamped to any support surface.

* * * * *